United States Patent [19]

Moetteli

[11] Patent Number: 4,602,534

[45] Date of Patent: Jul. 29, 1986

[54] RATCHET WRENCH

[76] Inventor: John B. Moetteli, 11524 Royalshire Dr., Dallas, Tex. 75230

[21] Appl. No.: 787,003

[22] Filed: Oct. 8, 1985

Related U.S. Application Data

[63] Continuation of Ser. No. 560,808, Dec. 13, 1983, abandoned, which is a continuation-in-part of Ser. No. 427,449, Sep. 29, 1982, Pat. No. 4,520,697.

[51] Int. Cl.[4] ..... B25B 13/06

[52] U.S. Cl. ..... 81/177.85; 279/79; 81/124.2; 81/124.3; 81/125

[58] Field of Search ..... 81/185, 124.1, 125, 81/121.1, 124.2, 124.3, 177.1, 177.85, 180.1; 403/329; 279/79-80

[56] References Cited

U.S. PATENT DOCUMENTS

| | | | |
|---|---|---|---|
| 125,695 | 4/1872 | Sanborn . | |
| 603,377 | 5/1898 | Fitch . | |
| 613,153 | 10/1898 | Kennelly . | |
| 897,584 | 9/1908 | Carlson . | |
| 1,165,995 | 12/1915 | Mossberg . | |
| 1,177,764 | 4/1916 | Dodge . | |
| 1,347,691 | 7/1920 | Forton . | |
| 1,413,698 | 4/1922 | Adams | 81/177 G |
| 1,433,163 | 10/1922 | Walters . | |
| 1,995,009 | 3/1935 | Pfauser et al. . | |
| 2,300,479 | 11/1942 | Wilson . | |
| 2,317,461 | 4/1943 | Jackson . | |
| 2,518,139 | 8/1950 | Hallowell et al. . | |
| 2,549,515 | 4/1951 | Orey et al. . | |
| 2,651,230 | 9/1953 | Waterval . | |
| 2,688,268 | 9/1954 | Lear . | |
| 2,715,955 | 8/1955 | Stone . | |
| 2,803,877 | 8/1957 | Belanger | 279/80 X |
| 2,989,881 | 6/1961 | Lavietes . | |
| 2,991,678 | 7/1961 | Adolphson | 81/185 |
| 3,078,973 | 2/1963 | Kilness . | |
| 3,096,659 | 7/1963 | Jenkins . | |
| 3,208,318 | 9/1965 | Roberts . | |
| 3,222,943 | 12/1965 | McDonald . | |
| 3,253,626 | 5/1966 | Stillwagon, Jr. et al. . | |
| 3,299,750 | 1/1967 | Campanile et al. . | |
| 3,342,229 | 9/1967 | Janes . | |
| 3,532,013 | 10/1970 | Haznar . | |
| 3,569,903 | 3/1971 | Brishka . | |
| 3,621,738 | 11/1971 | Northcutt . | |
| 3,677,102 | 7/1972 | Simonetta . | |
| 3,732,756 | 5/1973 | Thomasian . | |
| 3,777,596 | 12/1973 | Smyers, Jr. et al. . | |
| 3,881,376 | 5/1975 | Wright . | |
| 4,137,801 | 2/1979 | Imperio . | |
| 4,170,909 | 10/1979 | Wagner . | |
| 4,328,720 | 5/1982 | Shiel . | |
| 4,339,970 | 7/1982 | Enstrom . | |

FOREIGN PATENT DOCUMENTS

| | | |
|---|---|---|
| 2138245 | 2/1972 | Fed. Rep. of Germany . |

OTHER PUBLICATIONS

*Official Gazette* of the Patent Office, col. 883, No. 4, p. 1417 illustrates several socket wrench designs.

Black & Decker Catalog, p. 23.

*Primary Examiner*—Frederick R. Schmidt

*Assistant Examiner*—Debra S. Meislin

*Attorney, Agent, or Firm*—Richards, Harris, Medlock & Andrews

[57] ABSTRACT

An improved socket wrench (300) is provided which includes a first pawl (318) sliding on a first slide surface (312) and a second pawl (320) sliding on a second slide surface (314). At least one of the slide surfaces is not perpendicular to a radial line from the axis of rotation (27'') of the drive member (302) intersecting the plane of the slide surface when the slide surface is least distant from the rotational axis. This provides an increase in the number of pawl engagements per revolution over that possible with only a single pawl. A square drive to hex drive adapter (380) and a hex drive to square drive adapter (400). Finally, retainer spring (414) is used to frictionally engage sockets on a breaker bar (260).

8 Claims, 38 Drawing Figures

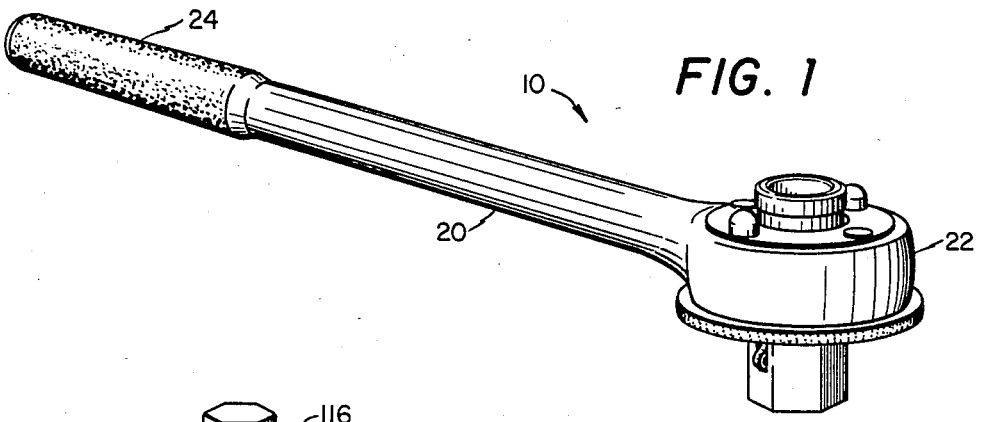
FIG. 1
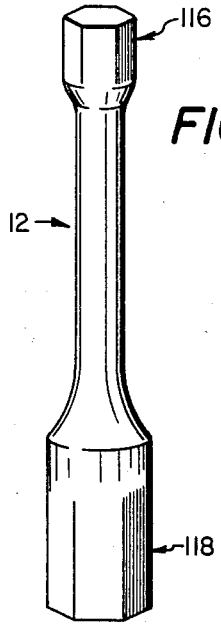
FIG. 2a
FIG. 2b
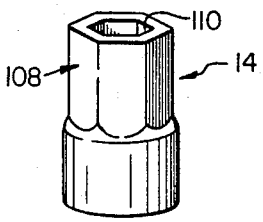
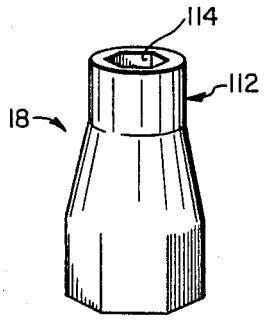
FIG. 2d
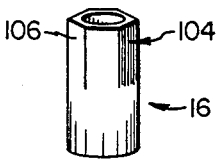
FIG. 2c

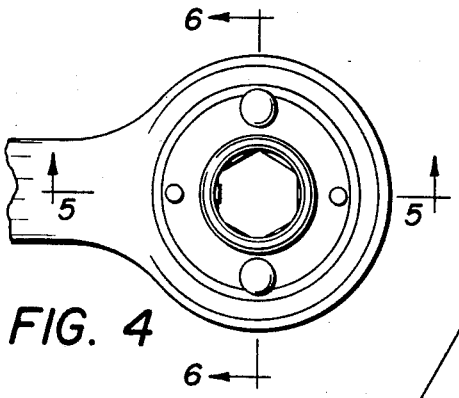
FIG. 4
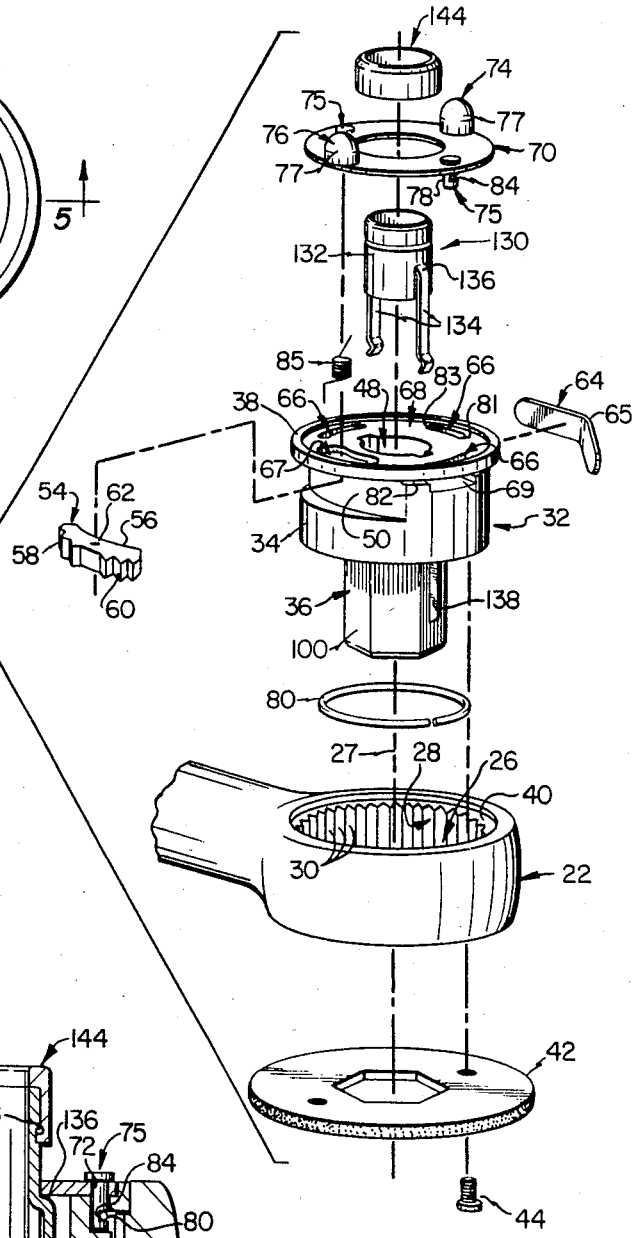
FIG. 3
FIG. 5
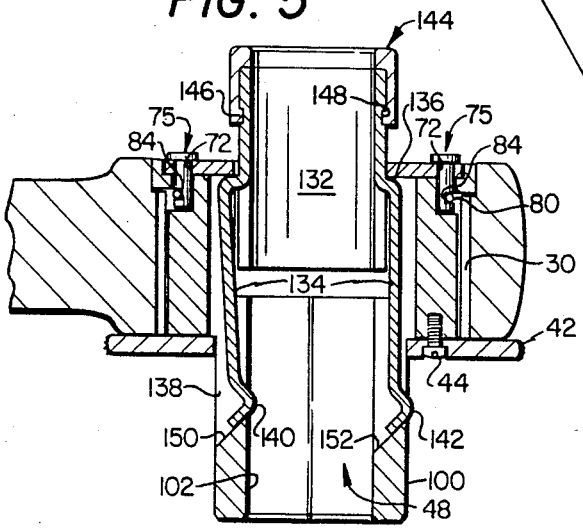

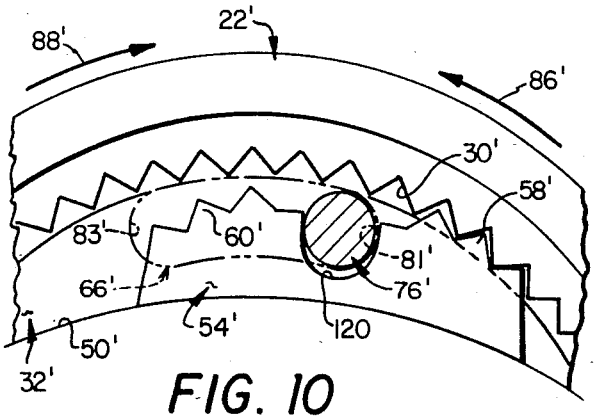
FIG. 10
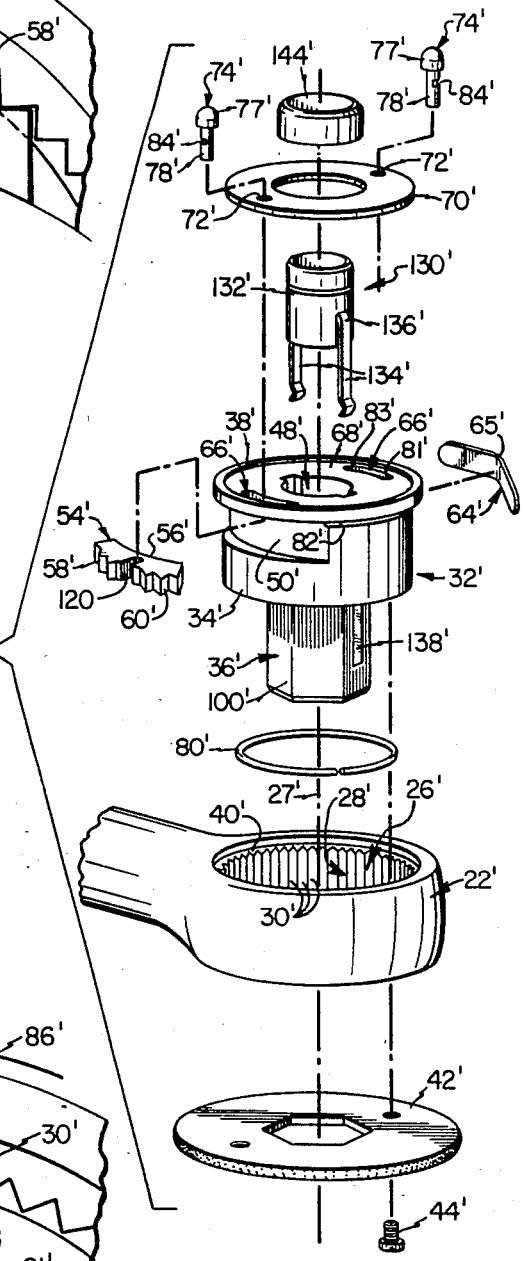
FIG. 9
FIG. 11
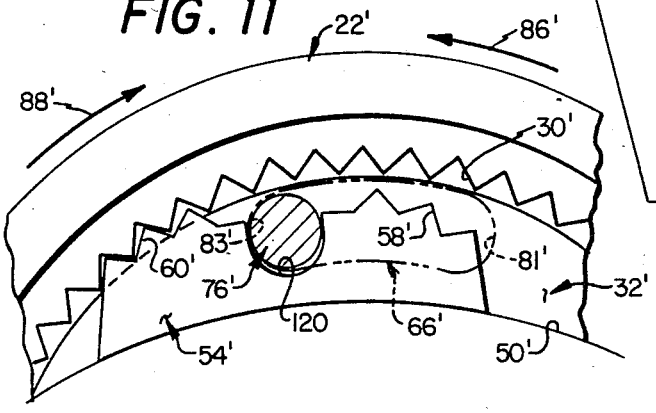

FIG. 17B
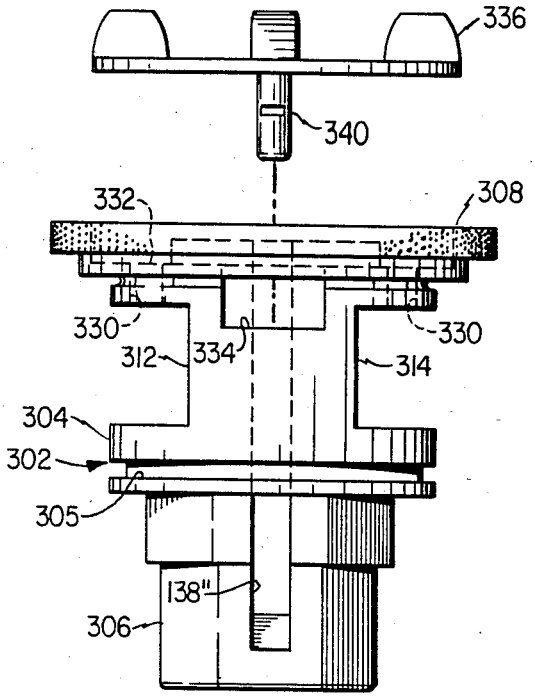
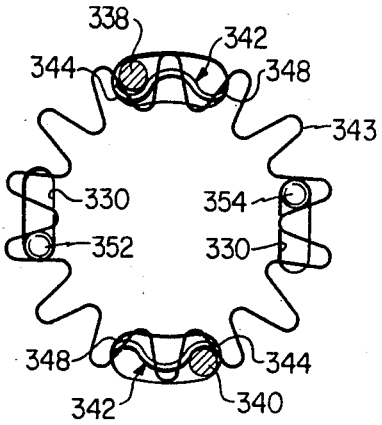
FIG. 19
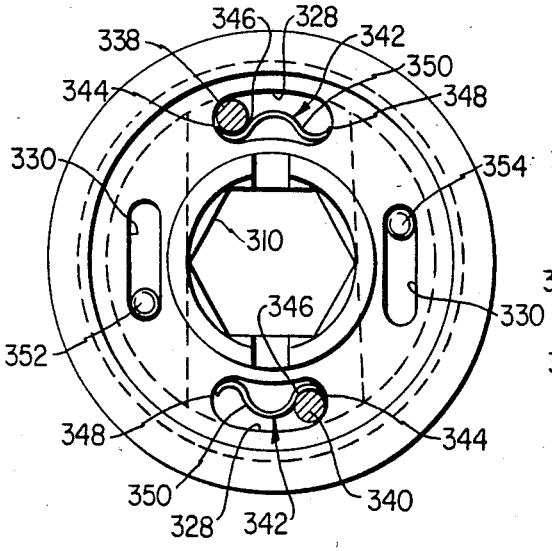
FIG. 18
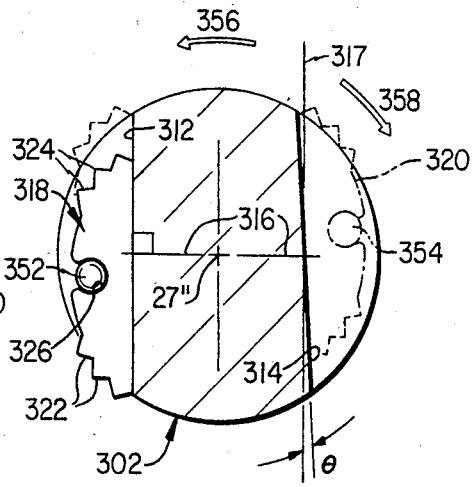
FIG. 20

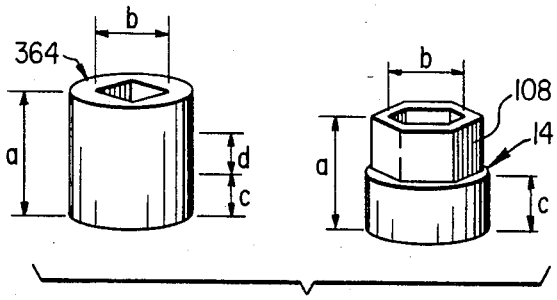
FIG. 22
FIG. 21
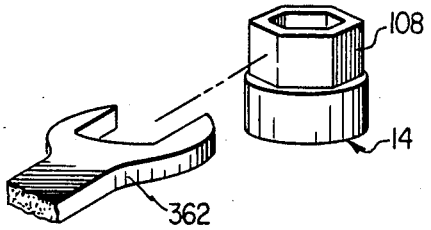
FIG. 23
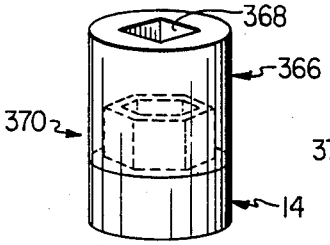
FIG. 24
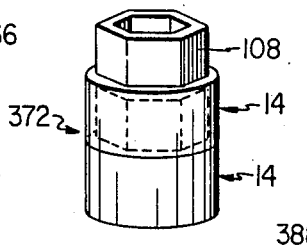
FIG. 25
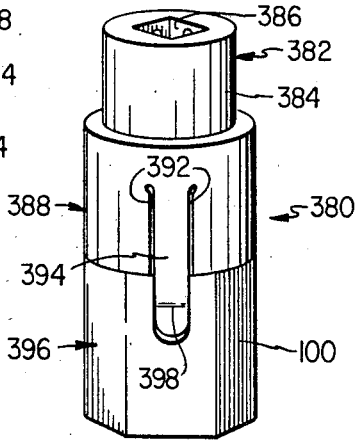
FIG. 26
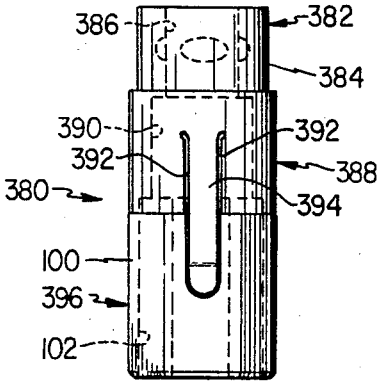
FIG. 27
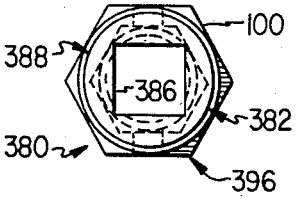

FIG. 28
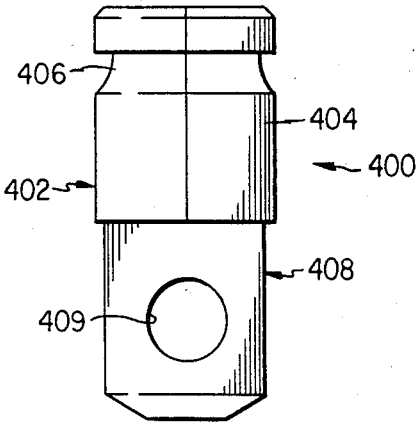
FIG. 29
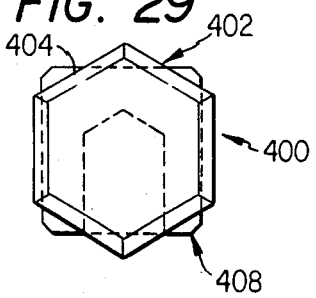
FIG. 32
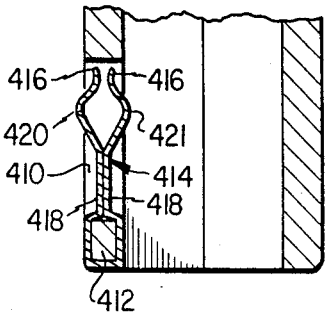
FIG. 30
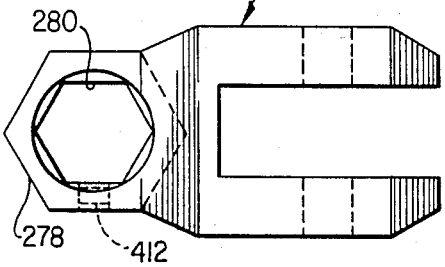
FIG. 31
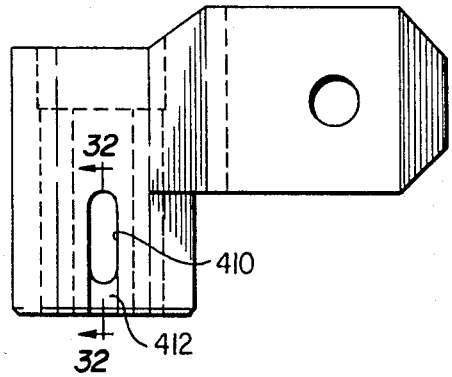
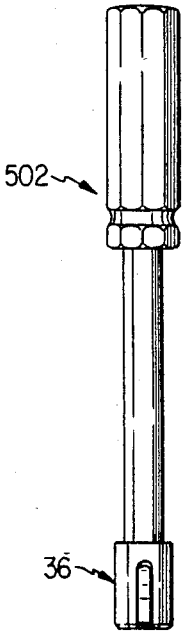
FIG. 33

RATCHET WRENCH

CROSS REFERENCE TO RELATED APPLICATION

This application is a continuation of application Ser. No. 560,808, filed Dec. 13, 1983, now abandoned, which is a continuation-in-part of U.S. patent application Ser. No. 427,449, filed Sept. 29, 1982, now U.S. Pat. No. 4,520,697.

TECHNICAL FIELD

This invention relates to hand tools, and in particular to reversible ratchet wrenches for rotating fasteners.

BACKGROUND OF THE INVENTION

The ratchet wrench has several advantages over the conventional closed or open end wrench. The fastener to be tightened or loosened is commonly in a confined location where a wrench has only a limited arc of motion when placed on the fastener. With an open end or a closed end wrench, the wrench must be removed from the fastener each time the limit of the arc of motion is reached and then repositioned. The ratchet wrench can be retained on the fastener with the ratcheting mechanism permitting the wrench to be readily returned to the initial point of motion without the wrench being removed from the fastener. When a reversible ratchet is provided, the wrench can be rotated freely in either direction as needed.

The ratchet wrench has in the past had one significant shortcoming relative to the closed or opened ended wrench. The wrench engaging surfaces of the fastener can often be a considerable distance from the end of the fastener, such as where the fastener is the common automotive spark plug where the wrench engaging surfaces lie along the length of the spark plug, or when a member, such as a bolt on which the fastener is secured, extends through the fastener. The conventional closed or opened end wrench can be simply slid over the end of the spark plug or bolt onto the wrench engaging surfaces of the fastener. The common ratchet wrench is provided with a square drive to engage a square aperture in a socket. The ability of the socket to contact the wrench surfaces on the fastener is therefore determined solely by the length of the socket. Long experience has shown that two different length socket sets are required for the majority of applications, including a so-called "short" socket set for use in tight areas and a so-called "deep" socket set for use with spark plugs, fasteners with through bolts, etc. This leads to great expense in necessitating the purchase of two complete socket sets. In addition, as the wrench handle is moved away from the fastener to permit the longer "deep" socket to be positioned between the wrench and fastener, the user must be careful to avoid applying a moment perpendicular the desired rotational direction to avoid overstressing the fastener.

Attempts have been made to eliminate the need for multiple length socket sets in ratchet wrench design by providing a ratchet wrench having a hole through the wrench and centered on the axis of rotation of the drive portion of the ratchet wrench. U.S. Pat. No. 125,695 to Sanborn, U.S. Pat. No. 1,165,995 to Mossberg and U.S. Pat. No. 2,317,461 all disclose a ratchet wrench with a through hole. The wrench in each of these patents is adapted for only a single fastener size. U.S. Pat. Nos. 1,347,691 to Forton and 2,300,479 to Wilson each discloses a ratchet wrench with a through hole which is adapted for using interchangable sockets to use the wrench with a range of fastener sizes. However, none of the wrenches disclosed in these patents permit the ratcheting direction to be reversed without turning over the wrench. In addition, none of these designs utilize sockets of a weight, compactness, strength and size range comparable with standard square-drive sockets, and therefore are hardly commercially competitive with the standard square-drive socket.

In ratchet wrenches adapted for use with a socket set, it is common to provide a spring loaded detent to secure the socket on the drive member of the wrench during use. In recent years, mechanisms have been developed for quick release of the socket from the wrench by retraction of the detent. Such mechanisms are described in U.S. Pat. Nos. 3,208,318 to Roberts and 3,532,013 to Haznar. These mechanisms, however, require a number of parts, which increase costs, and cannot be readily disassembled for repairs.

Most conventional ratchet wrenches are capable of ratcheting about 9° rotation between the socket and wrench before the ratcheting mechanism in the wrench becomes operable to secure the socket to the wrench for rotation in the desired direction. While some wrenches have been developed which have permitted a reduction in the angle, permitting more effective use of a ratchet wrench in a tight location, these designs have not proved completely satisfactory.

Another area where the known ratchet wrench is not effective is when the member to be tightened or loosened is adjacent an obstruction which prevents the socket and wrench from being placed over the member. Conventional sockets have a round cross section and cannot be separately rotated without the wrench in place. Therefore, even if the socket can be positioned over the member, if the wrench itself cannot be secured to the socket, the ratchet wrench is ineffective.

At the present time, no single ratchet wrench has been developed which incorporates the desired advantages noted above, including the presence of a through hole to eliminate the need of multiple sets of sockets and incorporating a quick release mechanism for the sockets used. A need therefore exists for such a socket wrench which is relatively uncomplicated in design and adaptable for inexpensive quantity production.

SUMMARY OF THE INVENTION

In accordance with one aspect of the present invention, a ratchet wrench is provided for rotating a fastener. The ratchet wrench includes a handle having a head at one end thereof, the head having a cylindrical aperture formed therethrough centered on an axis. A drive member is mounted onto the handle and extends into the cylindrical aperture for rotation about the axis relative to the handle. The drive member is operably connected to the fastener so that rotation of the drive member rotates the fastener. The drive member further defines an aperture extending therethrough along the axis. Ratchet means are provided for selectively ratcheting the handle in either rotational direction about the axis relative to the drive member.

In accordance with another aspect of the present invention, a ratchet wrench for rotating a fastener is provided. The ratchet wrench includes a handle having a head at one end thereof. The head includes a cylindrical aperture formed therethrough and centered on a rotational axis. The wall of the head defining the cylindrical aperture has ratchet teeth thereon around the entire periphery of the wall. A drive member is mounted in the handle through the cylindrical aperture for rotation about the rotational axis relative to the handle. The drive member is operably connected to the fastener so that rotation of the drive member also rotates the fastener. The drive member defines a slide surface facing the ratchet teeth in the head and further defines an aperture therethrough extending along the rotational axis. A pawl is positioned between the slide surface on the drive member and the ratchet teeth of the head and defines first and second sets of ratchet teeth thereon in facing relation with the ratchet teeth on the head. Means are provided for moving the pawl between first and second positions relative to the slide surface so that in the first position, the pawl is jammed between the ratchet teeth of the head and the slide surface when the handle is rotated in a first direction relative to the drive member, the moving means permitting rotation of the handle in the opposite direction relative to the drive member. When the pawl is in the second position relative to the slide surface, rotation of the handle in the opposite direction relative to the drive member is prevented and the moving means permits rotation of the handle in the first direction relative to the drive member.

In accordance with another aspect of the present invention, the drive member in the ratchet wrench defines two slide surfaces facing the ratchet teeth in the head. A pawl is positioned for sliding motion on each of the slide surfaces. Each pawl defines first and second sets of ratchet teeth thereon in facing relation with the ratchet teeth on the head. Structure is provided for moving the pawls between first and second positions relative to the slide surfaces so that in the first position, one of the pawls are jammed between the ratchet teeth of the head and the slide surface when the handle is rotated in a first direction relative to the drive member, the moving structure permitting rotation of the handle in the opposite direction relative to the drive member. When the pawls are in the second position relative to the slide surface, rotation of the handle in the opposite direction relative to the drive member is prevented and the moving structure permits rotation of the handle in the first direction relative to the drive member. The sliding surfaces are oriented so that the pawls do not engage the teeth on the head simultaneously to reduce the degrees of rotation necessary between the drive member and head between engagement of a pawl and the head.

In accordance with another aspect of the present invention, adapters are provided for adapting the ratchet wrench and sockets of the present invention to conventional square drive wrenches and socket.

In accordance with another aspect of the present invention, the hex sockets employed with the ratchet wrench have wrench surfaces on the outer surface thereof for use with a conventional open end or boxed wrench for tightening or loosening a member. The hex sockets can be used with other hex sockets or with regular sockets to form a deep socket.

In accordance with another aspect of the present invention, means are provided for securing a socket onto the drive member. Means are also provided for deactivating the means for securing the socket to permit the socket to be removed from the drive member.

BRIEF DESCRIPTION OF THE DRAWINGS

A more complete understanding of the invention can be had by referring to the following Detailed Description together with the accompanying Drawings, wherein:

FIG. 1 is a perspective view of the first embodiment of an improved ratchet wrench constructed in accordance with the teachings of the present invention;

FIG. 2*a* is a perspective view of an extension for use with the ratchet wrench shown in FIG. 1;

FIG. 2*b* is a perspective view of a socket for use with the ratchet wrench shown in FIG. 1 with a female wrench engaging portion for rotating fasteners of relatively large size;

FIG. 2*c* is a perspective view of a socket for use with the ratchet wrench shown in FIG. 1 having a male wrench engaging portion for rotating fasteners of relatively small size;

FIG. 2*d* is a perspective view of a deep-dish socket for use with the ratchet wrench shown in FIG. 1 with a female wrench engaging portion;

FIG. 3 is an exploded view of one construction of the first embodiment of the ratchet wrench shown in FIG. 1;

FIG. 4 is a top view of a portion of the ratchet wrench shown in FIG. 3;

FIG. 5 is a partial cross-sectional view of the ratchet wrench shown in FIG. 3 taken along line 5—5 in FIG. 4 in the direction of the arrows;

FIG. 9 is an exploded view of a ratchet wrench forming another construction of the first embodiment designed in accordance with the teachings of the present invention;

FIG. 10 is a partial cut-away view of the ratchet wrench shown in FIG. 9 illustrating the ratcheting mechanism of the wrench positioned to prevent motion in a first direction;

FIG. 11 is a partial cut-away view of the ratchet wrench shown in FIG. 9 illustrating the ratcheting mechanism of the wrench in a position preventing motion in the opposite direction;

FIG. 17B is a side view of a drive member found in the wrench forming the fourth embodiment of the present invention;

FIG. 18 is a partial horizontal cross sectional view of the drive member of FIG. 17A taken along line 18—18 in FIG. 17A in the direction of the arrows illustrating the reverser pins and springs;

FIG. 19 is a partial horizontal cross sectional view of the drive member shown in FIG. 17A taken along line 19—19 in FIG. 17A in the direction of the arrows illustrating the main spring;

FIG. 20 is a horizontal cross sectional view of the drive member of FIG. 17A taken along line 20—20 in FIG. 17A in the direction of the arrows illustrating the slide surfaces;

FIG. 21 is a perspective view of a hex socket of the present invention being rotated by a conventional open end wrench;

FIG. 22 is a perspective view of a hex socket and a conventional socket;

FIG. 23 illustrates the formation of a deep socket by use of a conventional socket and hex socket;

FIG. 24 illustrates the formation of a deep socket by the use of multiple hex sockets;

FIG. 25 is a perspective view of a square drive to hex drive adapter;

FIG. 26 is a side view of the square drive to hex drive adapter of FIG. 25;

FIG. 27 is an end view of the square drive to hex drive adapter of FIG. 25;

FIG. 28 is a side view of a hex drive to square drive adapter;

FIG. 29 is an end view of the hex drive to square drive adapter of FIG. 28;

FIG. 30 is a top view of a breaker bar head forming a first modification of the third embodiment of the present invention illustrating an alternative socket fastener structure;

FIG. 31 is a side view of the breaker bar head forming the first modification of the third embodiment;

FIG. 32 is a partial cross sectional view of the breaker bar head taken along line 32—32 in FIG. 31 in the direction of arrows illustrating the fastener structure;

FIG. 33 is a side view of a screwdriver mounting the combined male/female drive portion of the present invention.

DETAILED DESCRIPTION

Figure 6:
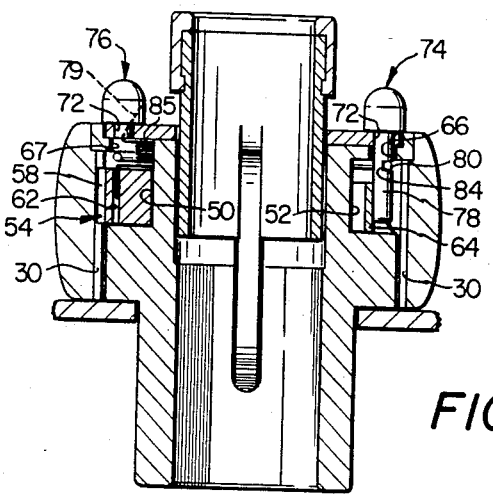
FIG. 6 is a partial cross-sectional view of the ratchet wrench of FIG. 3 taken along line 6—6 in FIG. 4 in the direction of the arrows.

Referring now to the drawings, wherein like reference numerals designate like or corresponding parts throughout several views, and in particular to FIGS. 1–8, there is illustrated a ratchet wrench 10 forming a first embodiment of the present invention which is adapted for use with an extension 12 and sockets 14–18, illustrated in FIGS. 2*a–d*, which also form a portion of the present invention, to rotate a fastener, such as a bolt, nut, or spark plug. It should also be understood that a fastener for purposes of this patent application will include any object or device which could be rotated or operated on by ratchet wrench 10.

As best shown in FIGS. 1 and 3–5, a first construction of the wrench 10 includes a handle 20 having an enlarged head 22 at one end and a knurled portion 24 at the opposite end for grasping by the user. As best seen in FIG. 3, the head 22 has a cylindrical aperture 26 formed therethrough centered on axis 27. The wall 28 of the head defining the cylindrical aperture is provided with ratchet teeth 30 parallel axis 27 and distributed along the entire periphery of the wall 28.

A drive member 32 is provided which generally includes a cylindrical portion 34 and a hexagonal drive portion 36. The upper edge of the cylindrical portion 34 has a flange 38 which rests on and rotates upon an annular inset 40 in the wall 28 of the head 22. The drive member 32 is secured to the handle 20 by a fastening plate 42 which is screwed into the underside of the cylindrical portion 34 by screws 44 as best seen in FIGS. 3 and 5. The fastening plate 42 has a sufficient diameter to contact the underside of the head 22 to prevent the drive member from separating from the handle 20. However, the drive member 32 is free to rotate within the head about axis 27. As can be seen in FIGS. 3 and 5, the drive member 32 has a large cylindrical aperture 48 which extends completely through the member and is centered on the axis 27. Aperture 48 permits the passage of a spark plug end, stud, rod, bolt or other elongate object so that the ratchet wrench 10 can be used on a fastener without need of deep dish sockets. This feature also permits the wrench to lie closer to the fastener which allows the wrench to be used in confined spaces. It also reduces the components of force applied to a fastener by the wrench other than the rotational torque needed to rotate the fastener.

The drive member 32 is formed with a slide surface 50 and a spring receiving recess 52 which extend into opposite sides of the cylindrical portion 34 as best seen in FIGS. 3 and 6. The slide surface 50 is curved with a radius larger than the radius of the cylindrical portion 34 so that the edges of the slide surface merge with the outer surface of the cylindrical portion while the center of the slide surface is inset from the outer surface of the cylindrical portion. A pawl 54 is inserted between the drive member 32 and wall 28 to ride on the slide surface. The pawl 54 has a curved inner surface 56 for sliding on slide surface 50. The pawl 54 defines a first set of ratchet teeth 58 and a second set of ratchet teeth 60 on the side opposite surface 56. A vertical hole 62 is formed through pawl 54 between the teeth 58 and 60. The first and second set of ratchet teeth 58 and 60 face the ratchet teeth 30 on wall 28. A V-shaped spring 64 is inserted into recess 52 with its apex 65 facing the head 22 and centered within the recess 52.

Figure 7:
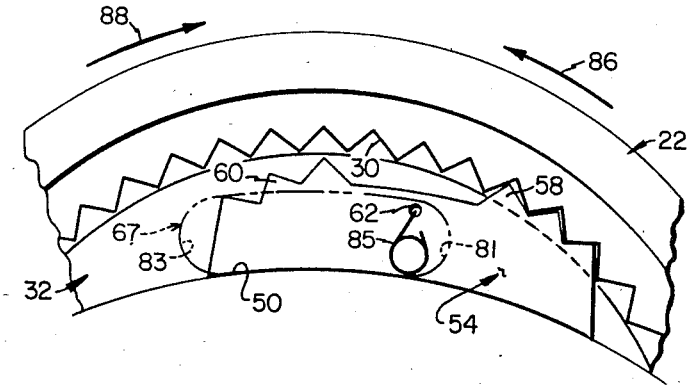
FIG. 7 is a partial cut-away view of the ratchet wrench shown in FIG. 3 illustrating the ratcheting mechanism of the wrench positioned to prevent motion in a first direction.
Figure 8:
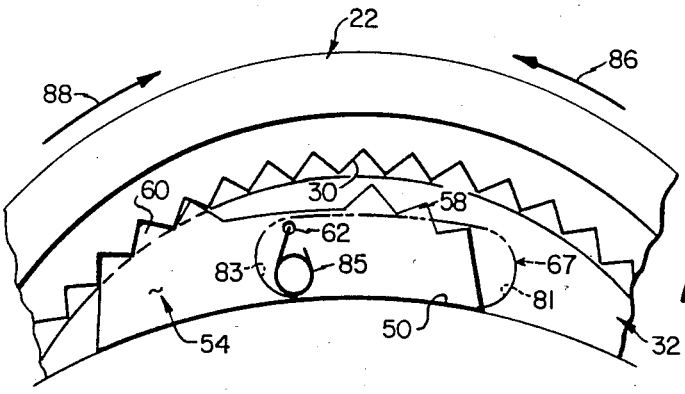
FIG. 8 is a partial cut-away view of the ratchet wrench shown in FIG. 3 illustrating the ratcheting mechanism in a position preventing motion in the opposite direction.

The drive member 32 is formed with three curvilinear notches 66 and one curvilinear notch 67 which extend from the upper surface 68 of the drive member into the member. The notches 66 and 67 are centered at a 90° angle apart from the adjacent notches about axis 27. Two notches 66 extend into cutouts 69 in cylindrical portion 34. Notch 67 and the other notch 66 extend into the insets defined by the slide surface 50 and recess 52, respectively. The hole 62 in the pawl 54 is continuously aligned with the curvilinear notch 67 when the pawl is positioned between the drive member 32 and wall 28 as seen in FIGS. 7 and 8.

An annular reverser plate 70 is positioned on the upper surface 68 and includes pin holes 72 to accept reverser pin 74, guide pins 75 and knob pin 76. The reverser pin 74 has a relatively large diameter knob portion 77 and a relatively reduced diameter portion 78. The holes 72 are sized to permit passage of portion 78 and block passage of portion 77. The portion 78 extends through the curvilinear notch 66 and into the spring recess 52 between spring 64 and wall 28. The knob pin 76 includes a knob portion 77 but does not extend below the bottom of reverser plate 70. A small hole 79 is formed in the knob pin 76 as best seen in FIG. 6 to receive one end of a rotary spring 85. The other end of spring 85 is received in hole 62 of pawl 54 while the main spiral body of spring 85 is contained within groove 67 of drive member 32.

A resilient ring 80 is provided which rests in a notch 82 formed in the drive member 32 and in notches 84 formed in the portion 78 of reverser pin 74 and guide pins 75 to retain the pins and reverser plate on the drive member 32 as best seen in FIGS. 5 and 6.

The ratcheting operation is explained as follows. The spring 64 urges the reverser pin 74 into one of two positions against the end walls 81 or 83 of the notch 66 as shown in FIG. 3. The pin 74 rotates the plate 70 as it moves between end walls 81 and 83. As plate 70 rotates relative to drive member 32, the spring 85 is extended and resiliently urges pawl 54 to move with the plate 70. When pin 74 abuts end 81, the spring 85 urges pawl 54 into a first position on slide surface 50 as seen in FIG. 7. When pin 74 abuts end 83, the spring 85 urges pawl 54 into a second position on slide surface 50 as seen in FIG. 8. In the first position illustrated in FIG. 7, the pawl is wedged between teeth 30 and one end of slide surface 50. In this position, if the head 22 is rotated in a direction indicated by arrow 86 in FIG. 7, the ratchet teeth 30 on the wall 28 will slide along the first set of ratchet teeth 58. The pawl 54 will move very slightly along the slide surface 50 to provide sufficient clearance for the ratchet teeth 30 to slide over the first set of ratchet teeth 58. The spring 85, constantly urges the pawl 54 into the first position between teeth 30 and the end of slide surface 50 to cause the pawl to spring back and create the ratcheting action. If, however, the handle 20 and head 22 are rotated in the opposite direction relative to drive member 32, represented by arrow 88, the pawl is wedged between the slide surface 50 and the wall 28 with the first set of ratchet teeth 58 engaging the ratchet teeth 30 to lock the drive member 32 and head 22 together for joint rotation as when tightening or loosening a bolt or nut.

An operator can reverse the ratcheting operation of the socket wrench 10 by grasping the reverser pin 74 and knob pin 76 at knob portions 77 and moving the pin 74 to a second position at the opposite limit of travel permitted by the curvilinear notch 66 against end wall 83 as seen in FIG. 3. When the handle 20 and head 22 are rotated in the direction indicated by arrow 86, the pawl 54 is again wedged between the slide surface 50 and the wall 28 of head 22 as seen in FIG. 8. The second set of ratchet teeth 60 engage the ratchet teeth 30 on the head for joint rotation of the handle 20 and drive member 32. When the handle 20 and head 22 are rotated in the direction indicated by arrow 88, ratcheting action again occurs. The ratchet teeth 30 will slide along the second set of ratchet teeth 60 with the spring 85 urging the pawl 54 back into the second position to create the ratcheting action. The spring 64 constantly tends to urge the reverser pin 74 either to the first end wall 81 or to the second end wall 83 depending upon which side of the midpoint of apex 65 the pin is located. The reverser pin 74 flexes spring 64 to a maximum when the pin is in contact with apex 65 midway between the edges of the curvilinear notch 66. In this position, the spring 64 can drive the pin to either end wall of the curvilinear notch 66 depending upon which direction the pin is moved.

Another construction of the reverser mechanism of wrench 10 is illustrated in FIGS. 9, 10 and 11. Certain components of this construction are identical to the components described above and are identified by the same reference numeral with a superscript prime (′). In this construction, the drive member 32′ is formed with curvilinear notches 66′ which extend from the upper surface 68′ of the drive member and into the insets defined by the slide surface 50′ and spring recess 52′. The pawl 54′ includes a notch 120 which is continuously aligned with the notch 66′ opening adjacent slide surface 50′ when the pawl is positioned between the drive member 32′ and wall 28′ as seen in FIGS. 10 and 11. The annular reverser plate 70′ is positioned on upper surface 68′ and includes pin holes 72′ to accept reverser pins 74′. The reverser pins 74′ have a relatively large diameter knob portion 77′ and a relatively reduced diameter portion 78′. The holes 72′ are sized to permit passage of portion 78′ and block passage of knob portion 77′. The portions 78′ extend through the curvilinear notches 66′ adjacent the slide surface 50′ and into the spring recess 52′. A resilient ring 80′ is provided which rests in a notch 82′ formed in the drive member 32′ as best seen in FIG. 9 and in notches 82′ formed in the portion 78′ of each reverser pin 74′ to retain the reverser pins and reverser plate on the drive member 32′.

The ratcheting operation is substantially identical to that of the pawl 54 described hereinabove. However, the ratcheting function of the resilient spring 85 is performed by the spring 64′ which acts to urge pin 74′ extending into recess 52′ against either end wall 81′ or 83′ of notch 66. The force of spring 64′ acts through this pin 74′, plate 70′ and the second pin 74′ extending adjacent slide surface 50′ which bears against the walls of notch 120 in pawl 54′ as seen in FIGS. 10 and 11.

Referring again to ratchet wrench 10 shown in FIGS. 1–8, while the head 22 has been described as having an annular set of ratchet teeth 30, and drive member 32 with a pawl 54, the present invention encompasses a design where a drive member has an annular set of ratchet teeth and the head supports the pawl.

The drive portion 36 of drive member 32 is adapted to secure any one of the sockets 14–18 thereon, as well as extension 12. The drive portion 36 defines an outer hexagonal surface 100 which defines a male drive portion and an inner hexagonal surface 102 which defines a female drive portion. The socket 16 illustrated in FIG. 2*c* includes a male connector portion 104 which has a hexagonal outer surface 106 adapted for engagement with the inner hexagonal surface 102 of the drive portion 36. The socket 14 illustrated in FIG. 2*b* is provided with a female portion 108 which includes an inner hexagonal surface 110 for engagement with the outer hexagonal surface 100 of the drive portion 36. The design of socket 16 will be typically employed for small bolts, nuts, etc. Socket 14 can be employed with larger bolts or nuts. Sockets 14 and 16 each have a through center aligned with aperture 48 to permit use of wrench 10 on fasteners with bolts extending onto aperture 48, etc. The socket 18 includes a female connector portion 112 with an inner hexagonal surface 114 for engagement with the outer hexagonal surface 100 of the drive portion 36. The length of the socket 18 is considerably more than that of socket 14 to give the deep socket advantages to wrench 10 where the shank diameter of the bolt or rod to which the fastener is secured exceeds the diameter of aperture 48. The extension 12 includes a male connector portion 116 for engagement with the drive portion 36 and female connector portion 118 for use with either socket 14 or 16 if an extension is needed.

Figure 34:
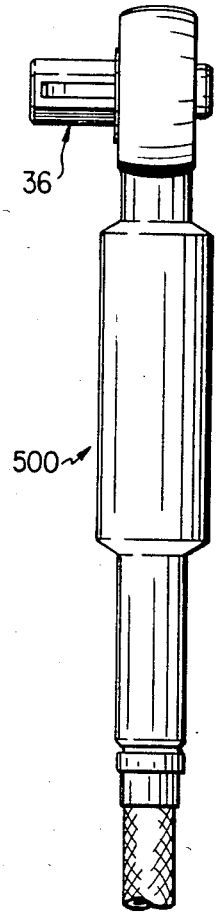
FIG. 34 is a side view of a power wrench mounting the combined male/female drive portion of the present invention.

The hexagonal drive portion 36 is stronger and can withstand a higher rotational torque than a similarly sized square drive wrench. The combined male and female drive portions of the hexagonal drive portion 36 also forms a significant advantage over conventional square drives. Because the hexagonal drive portion 36 can accept relatively small hex sockets such as socket 16 and extension 12 with the female drive portion and relatively large hex sockets such as socket 14 and 18 on the male drive portion, the hexagonal drive portion 36 can be used over a broader range of socket sizes than the conventional square drive. For example, a single size hexagonal drive portion 36 can be used for socket sizes that would normally require use of a ⅜" square drive and ½" square drive. The cross section of the aperture formed by the female hexagonal drive surfaces of the combined male/female drive portion, such as inner surface 102, permits the passage of bolt shanks, etc. which a conventional square drive couldn't. The advantage of the combined male and female drive portions do not need to be limited to rachet wrenches, but can be used on power wrenches such as air powered wrench 500 shown n FIG. 34, breaker bar wrenches such as wrench 260 is FIG. 16, screwdriver handled socket wrenches such as screwdriver wrench 502 shown in FIG. 33 or whatever else the combined male and female drive portions would be useful. The length and weight of sockets 14–16 are also decreased over equivalent conventional sockets while the width of the drive portion socket combination remains comparable.

The socket wrench 10 is also provided with a socket locking and quick release feature. The member 130, best seen in FIGS. 3 and 5, has a cylindrical portion 132 and two resilient downwardly extending legs 134. The member 130 is placed in the aperture 48 in the drive member 32 prior to attachment of the reverser plate 70. Shoulders 136 defined between the cylindrical portion and legs contact the underside of the reverser plate 70 to keep the member 130 within the drive member 32. The drive portion 36 is provided with notches 138 on opposed hexagonal sides. The legs 134 extend into these notches as best seen in FIG. 5. The leg 134 seen on the left side in FIG. 5 has an inwardly bent shoulder 140 for bearing against the outer hexagonal surface of socket 16 and extension 12. This maintains the socket 16 or extension 12 on the socket wrench 10 with the frictional contact through the shoulder 140. The socket or extension can be provided with a notch about its outer hexagonal surface in which the shoulder 140 can enter. The leg 134 seen on the right in FIG. 5 has an outwardly directed shoulder 142 for frictional engagement with the inner hexagonal surface of the sockets 14 and 18. Again, the sockets 14 and 18 can have a groove on their inner hexagonal surface to accept the shoulder 142. A resilient button 144 is attached to the cylindrical portion 132 as seen in FIG. 5. The button can be provided with an annular edge 146 which enters a groove 148 on cylindrical portion 132. The button has a sufficiently larger surface area for contact with the operator to permit the operator to comfortably operate the socket locking and quick release feature. By pressing the button 144 downward toward the drive member 32, the member 130 is moved downward within the drive member and the shoulders 140 and 142 slide downward on camming edges 150 and 152 of the notches 138. The edges are angled so that the shoulders 140 and 142 retract into the notches 138 when the member 130 is depressed to release a socket or extension on the drive portion.

Figure 14:
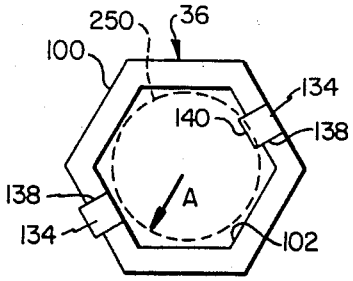
FIG. 14 is a cross-sectional view of the drive portion of the ratchet wrench forming the first embodiment.

FIG. 14 illustrates the cross section of the drive portion 36 of drive member 32. The notches 138 are formed on opposite sides of the drive portion within the flat portions of the hexagonal sides. As is clear from FIG. 14, the inwardly bent shoulder 140 of the leg 134 employed to secure a socket 16 on the wrench can interfere with passage of an object 250 having a diameter A over which the wrench is placed to rotate the fastener. Object 250 could comprise, for example a rod, bolt or other structure.

Figure 15:
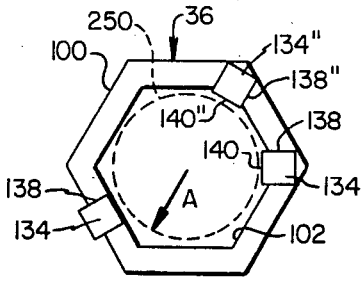
FIG. 15 is a cross-sectional view of a modified drive portion.

An alternate design for the drive member 32 which prevents this interference is illustrated in FIG. 15. In this alternate design, the notch 138 which receives the leg 134 for holding a socket 16 is positioned at the corner between two flat surfaces of the hexagonal shape. In this design, the inwardly bent shoulder 140 extends from the inner section of the two adjacent hexagonal surfaces on inner hexagonal surface 102. This will permit free passage of an object 250 having a diameter A as shown in FIG. 15 which could not pass through the drive portion as illustrated in FIG. 14. The alternate design also illustrates the use of a third leg 134" lying within a third notch 138" located between two flat surfaces of the drive portion 36. The leg 134" also has a bent shoulder 140" to hold a socket 16 to increase the force holding the socket.

It is readily apparent that socket wrench 10 incorporates the significant advantages desired in a socket wrench as noted previously. The ratcheting action is reversible without turning the wrench over by merely moving the reverser pins 74. In fact, to reverse the ratchet operation, the knob portions 77 are always rotated in a direction to wedge pawl 54 between head 22 and drive member 32. Thus, drive member 32 need not be held against rotation relative to head 22 when reversing the wrench which permits reversal of the wrench with one hand. The aperture 48 within the drive member 32 permits a socket on the socket wrench 10 to be fit over a fastener to be rotated even though some portion of the fastener, or other part protrudes through the aperture 48. Socket wrench 10 also has the weight, compactness, strength and size range to be an improvement on and competitive with conventional square drive wrenches. In addition, the combined male and female drive portion 36 and hex sockets are comparable and competitive with conventional square drive and sockets whether the combined male and female drive portion 36 is mounted on a ratchet wrench, breaker bar wrench, power wrench, screwdriver wrench, etc. The socket wrench 10 also has the advantage of a socket locking and quick release feature which has only two pieces and which can be disassembled with the rest of wrench 10 for repair or maintenance.

Figure 12:
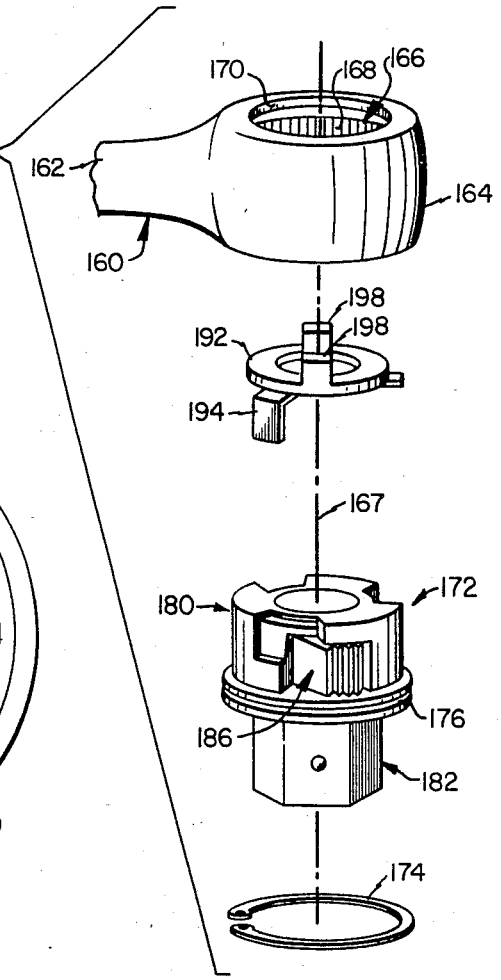
FIG. 12 is an exploded view of a ratchet wrench forming a second embodiment designed in accordance with the teachings of the present invention.

A second embodiment of the present invention is formed by socket wrench 160, illustrated in FIGS. 12 and 13 and described hereinafter. The socket wrench 160 includes a handle 162 with head 164. The head is again provided with a cylindrical aperture 166 centered on an axis 167 having ratchet teeth 168 formed on the inner wall 170 of the aperture. A drive member 172 is secured within the aperture 166 by a snap ring retainer 174. The retainer 174 fits in a groove 176 formed about the drive member 172 and also into a groove in the wall 170 (not shown). The retainer 174 prevents movement of the drive member 172 along the axis 167 but permits the drive member 172 to rotate freely about the axis 167 relative to the handle 162.

The drive member 172 includes a cylindrical portion 180 and a drive portion 182 substantially identical to drive portion 36 in socket wrench 10.

Figure 13:
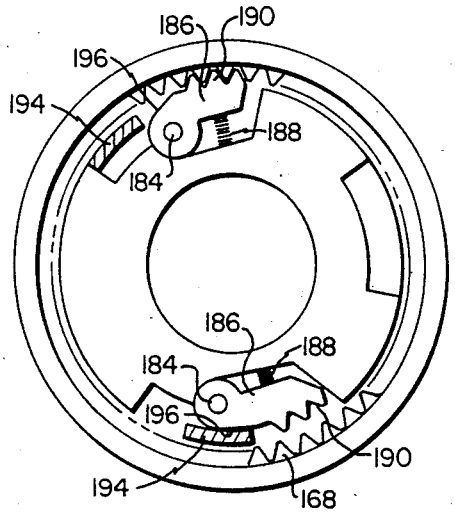
FIG. 13 is a cut-away view of the ratchet wrench forming the second embodiment illustrating the ratchet mechanism.

The cylindrical portion 180 of the drive member 172 supports pawl pivot pins 184, pawls 186 and compression springs 188 as best seen in FIG. 13. The pawls 186 can pivot on the pins 184 about an axis generally parallel axis 167. Each pawl 186 is provided with a set of ratchet teeth 190. In the absence of an external force, the compression springs 188 urge the pawls about the pawl pins to engage the ratchet teeth 190 with the ratchet teeth 168 in head 164 as best seen with the upper pawl in FIG. 13. The ratchet teeth 190 are designed to engage and lock against ratchet teeth 168 in only one direction of relative motion while permitting the ratchet teeth to slide over one another during opposite rotation. A reverser plate 192 is confined between an edge on aperture 166 and the drive member 172. This reverser plate has two downwardly directed members 194 which are capable of contacting camming surfaces 196 on the pawls 186 to move the pawls out of engagement with the teeth 168. The members 194 are positioned on plate 192 so that each one of the pawls can be out of engagement with teeth 168 while the other pawl is engaged. The teeth 190 on pawls 186 are formed to prevent relative rotation between head 164 and drive member 172 in one direction, while permitting the teeth 168 to slide over teeth 190 in the opposite direction to provide a ratcheting action. The pawls 186 are mounted to prevent rotation in opposite directions so that ratcheting action can occur in either direction depending upon the position of the members 194. The reverser plate 192 can be moved relative to the drive member 172 through finger grips 198 to permit ratcheting of the socket wrench 160 in either direction.

Figure 16:
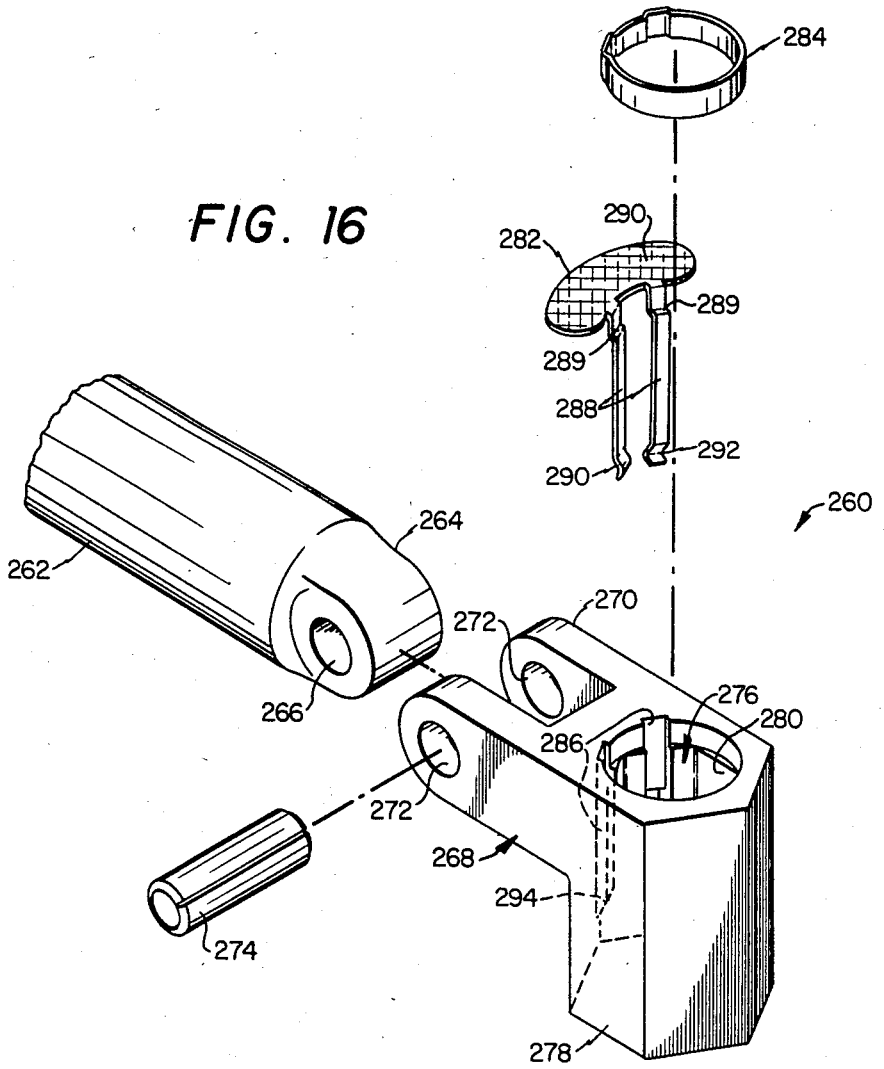
FIG. 16 is an exploded view of a breaker bar wrench forming a third embodiment of the present invention.

A third embodiment of the present invention is illustrated in FIG. 16 and comprises a breaker bar wrench 260. The breaker bar wrench 260 includes a long handle 262 with an end 264 having a reduced portion and an aperture 266. A head 268 also forms a portion of the breaker bar wrench 260 which includes a clevis 270 having an aperture 272 through the two arms of the clevis. The reduced end 264 of handle 262 can be received between the arms of the clevis 270 and a pin 274 can be inserted through the apertures 266 and 272 to secure the handle and head together. It will be clear that the pin 274 permits the head 268 to rotate about the axis of the pin relative to handle 262 but limits motion in any other direction.

The head 268 has a through aperture 276 which permits passage of a bolt, rod, spark plug or other object associated with the fastener to be rotated. The head defines an outer hexagonal surface 278 and an inner hexagonal surface 280 which can be used to secure sockets 14, 16 and 18 or extension 12 thereto in a manner substantially identical to the drive member 32 described in association with wrench 10.

The breaker bar wrench 260 has a socket locking and quick release feature which comprises the push button release 282 and a press fit retaining ring 284 which cooperate with notches 286 formed in the head 268. The push button release 282 includes two downwardly extending resilient legs 288 which are each received in one of the notches 286. The push button release 282 also defines a grooved surface 291 for contact with the finger of the operator. The press fit ring 284 is secured to head 268 by compression fit in aperture 276 and maintains the push button release 282 on the wrench 260 through contact with shoulders 289 on legs 288. The legs 288 operate in a manner substantially identical to the legs 134 within wrench 10 described hereinabove. One leg 288 has an inwardly bent shoulder 290 for bearing against the outer hexagonal surface of the socket 16 and extension 12 when they are in contact with the inner hexagonal surface 280 of the head 268. The other leg has an outwardly bent shoulder 292 which bears against sockets 14 and 18 when they are in contact with the outer hexagonal surface 278. The shoulders 290 and 292 secure the sockets or extension to the wrench 260. The bottom end of the notches 286 also include angled edges 294. When the push button release 282 is pushed downwardly toward the head 268 by the operator, the legs 288 are urged against the angled edges 294 to retract the shoulders 290 and 292 within the notches to release the sockets or extension. When released, the resiliency in the legs 288 returns the shoulders 290 and 292 to a position extending out of the notches for receiving a socket.

The fourth embodiment of the present invention is illustrated in FIGS. 17–20 and forms a ratchet wrench 300. Many portions of the ratchet wrench 300 are identical to those portions identified previously in the description of wrench 10. The identical elements are denoted by the same reference numeral with a double prime superscript.

The ratchet wrench 300 includes a handle 20″ having head 22″. The head 22″ has a cylindrical aperture 26″ therethrough with the aperture 26″ centered on axis 27″.

A drive member 302 is provided which generally includes a cylindrical portion 304 and a hexagonal drive portion 306. The upper edge of the cylindrical portion 304 has a flange 308 which rests on and rotates upon the annular inset 40″ in the wall 28″ of the head 22″. The drive member 302 is secured to the handle 20″ by a retainer ring 303 setting in groove 305 in drive member 302 and a similar groove (not shown) in wall 28″. This permits the drive member 302 to rotate relative to the head 22″ about axis 27″.

The drive member 302 has a large cylindrical aperture 310 which extends completely through the drive member 302 and is also centered on axis 27″ when mounted in the head 22″. The aperture 310 provides the features and advantages of aperture 48 as described previously.

Figure 17A:
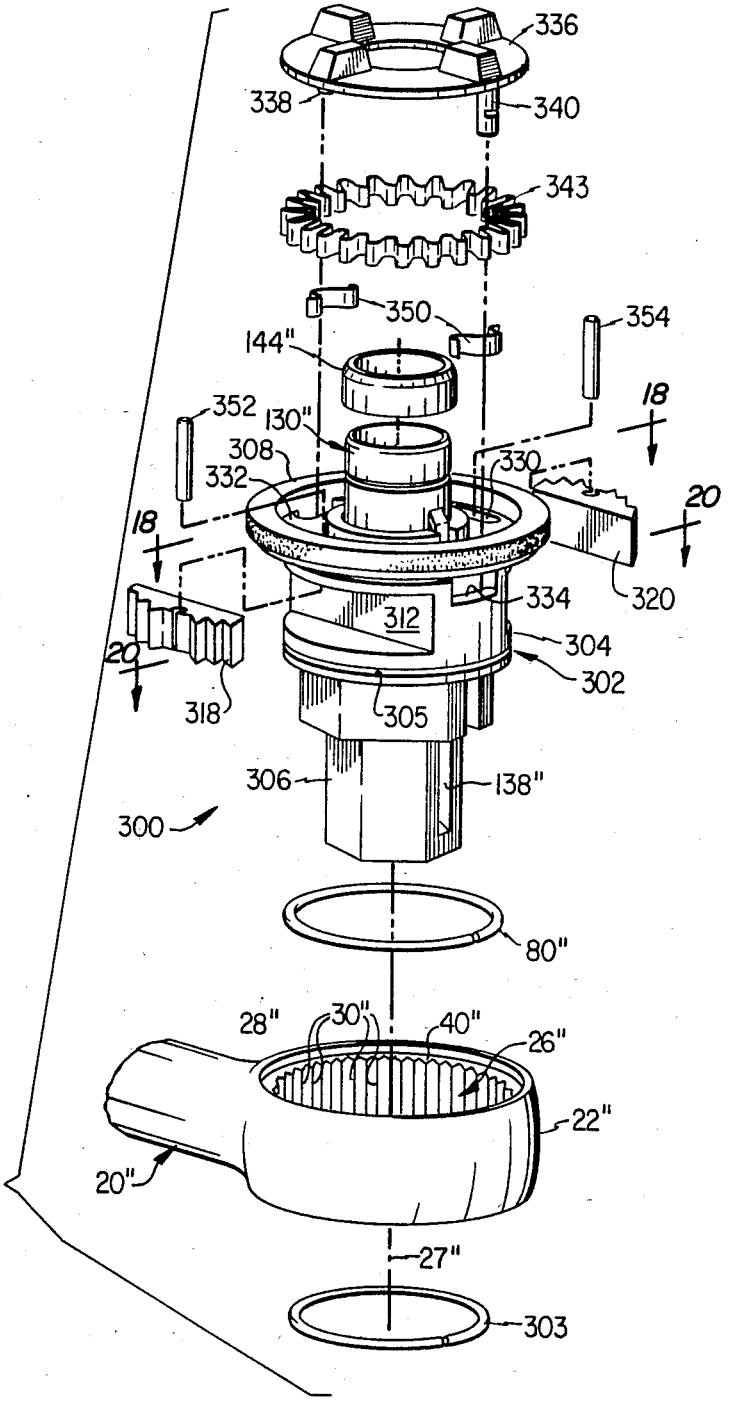
FIG. 17A is a perspective view of a wrench forming a fourth embodiment of the present invention.

The drive member 302 is formed with opposed slide surfaces 312 and 314 as best seen in FIGS. 17A and 20. The slide surfaces 312 and 314 are planar as best seen in FIG. 20. Slide surface 312 extends perpendicular a radial line 316 extending from the axis 27″ to the closest intersection with slide surface 312 as seen in FIG. 20. However, slide surface 314 is not perpendicular to a radial line 316 intersecting it at its closest point to axis 27″. In the preferred invention, the head 22″ has forty-eight ratchet teeth 30″ and the angle $\theta$ between the slide surface 314 and a line 317 perpendicular radial line 316 is 3° 45 minutes. A first pawl 318 is positioned between slide surface 312 and the teeth 30″ in head 22″. A second pawl 320 is positioned between slide surface 314 and the ratchet teeth 30″. Both pawls 318 and 320 ride on their respective slide surfaces 312 and 314.

Each of the pawls 318 and 320 define a first set of ratchet teeth 322 and a second set of ratchet teeth 324 facing the ratchet teeth 30″. A vertical hole 326 is formed through the pawls 318 and 320 between the teeth 322 and 324 as best seen in FIG. 20.

The drive member 302 is formed with two curvilinear notches 328 and two linear notches 330 as best seen in FIG. 18. The curvilinear notches 328 extend from the upper surface 332 of the drive member 302 into cutouts 334 in the drive member 302. The linear notches 330 extend from the upper surface 332 and open into the gap formed by the slide surfaces 312 and 314. The vertical holes 326 in the pawls 318 and 320 are continuously aligned with the linear notches 330 when the pawls are positioned between the slide surfaces and ratchet teeth 30''.

An annular reverser plate 336 is positioned on the upper surface 332 and includes reverser pins 338 and 340. When the reverser plate 336 and reverser pins 338 and 340 are secured to the cylindrical portion 304 by resilient ring 80'' in a manner similar to reverser plate 70 to drive member 32, the reverser pins 338 and 340 extend into the curvilinear notches 328 as best seen in FIG. 18. Reverser springs 342, best seen in FIG. 18, selectively urge the reverser pins 338 and 340 against one or the other of the ends of the curvilinear notches 328. As can be seen in FIG. 18, the reverser springs 342 are urging the reverser pins 338 and 340 against the end 344 of the curvilinear notch 328 by contact with portion 346 of the reverser spring 342. When the reverser plate 336 is rotated in the clockwise direction as illustrated in FIG. 18, the reverser pin 338 and 340 will compress the reverser springs 342 and the reverser pins move into contact with the ends 348 of the curvilinear notches 328 opposite the ends 344. The portion 350 of the reverser springs 342 will then keep the reverser pins against ends 348 until the reverser plate 336 is rotated in the counterclockwise direction as seen in FIG. 18 by the operator.

The ratcheting operation is explained as follows. The reverser springs 342 urge the reverser pins 338 and 340 into one of the two positions against the ends 344 and 348 of the curvilinear notches 328. The position of the reverser plate 336 is determined by the position of the reverser pins 338 and 340. Pawl pins 352 and 354 are provided which extend through linear notches 330 and extend into the vertical hole 326 of each of the pawls 318 and 320. A continuous main spring 343 extends about the periphery of drive member 302. Main spring 343 is movable by rotation about axis 27'' by reverser pins 338 and 340 as best seen in FIG. 19. When reverser pins 338 and 340 are in contact with the ends 344 of the curvilinear notches 328, the main spring 343 urges the pawl pins 352 and 354 to move the pawls 318 and 320 into a first position on the slide surfaces 312 and 314 as seen in FIG. 20. When reverser pins 338 and 340 contact the ends 348 of the curvilinear notches 328, the reverser pins 338 and 340 move the main spring 343 and pawl pins 352 and 354 to move the pawls 318 and 320 into the second position, illustrated by pawl 318 shown in phantom line in FIG. 20.

In the first position illustrated in FIG. 20, only the first set of ratchet teeth 322 of the first pawl 318 are wedged between the teeth 30'' and the slide surface 312. The first set of ratchet teeth 322 on the second pawl 320 are disengaged from the ratchet teeth 30'' because of the slight angle $\theta$ between the slide surface 314 and the line 317 perpendicular to radial line 316. In this position, if the head 22'' is rotated in a direction indicated by arrow 356 in FIG. 20, the first pawl 318 is wedged between the slide surface 312 and the ratchet teeth 30'' to lock the drive member 302 and head 22'' together for joint rotation as when tightening or loosening a bolt or nut.

If head 22'' is rotated in the direction indicated by arrow 358 in FIG. 20, the pawl 318 will move very slightly along the slide surface 312 against the force of main spring 343 to provide sufficient clearance for the ratchet teeth 30'' to slide over the first set of ratchet teeth 322 on the first pawl 318. The main spring 343 constantly urges the first pawl 318 into the first position to cause the pawl 318 to spring back and create a ratcheting action. However, prior to pawl 318 springing back to engage the first set of ratchet teeth 322 thereof with the ratchet teeth 30'' on head 22'', the second pawl 320 moves its first set of ratchet teeth 322 into engagement with the ratchet teeth 30'' on head 22''. When the first set of ratchet teeth 322 of the second pawl 320 engage the ratchet teeth 30'', the head 22'' can be rotated in the direction of arrow 356 with the drive member 302 locked for rotation with the head 22''. It will thus be evident that the angle of rotation of the drive member 302 relative to the head 22'' between ratchet engagements by use of the first and second pawls 318 and 320 is smaller than that possible by use of a single pawl alone. This reduced angle between ratchet engagement is possible by forming the slide surfaces 312 and 314 at different angles of intersection from radial lines 316 extending from the rotational axis 27'' intersecting the surfaces 312 and 314 closest to axis 27''. For example, if forty-eight teeth 30'' are formed on head 22'', with a single pawl, the head 22'' would have to rotate 7° 30 minutes between engagements of the pawl teeth and teeth 30''. With two pawls positioned to engage teeth 30'' alternatively, the angle of rotation between engagements can be reduced to a constant 3° 45 minutes. It will be understood that the slide surface 312 need not be perpendicular to the radial line 316. The slide surface 312 can also be at a slight angle to a line 317 perpendicular the radial line 316 as is the slide surface 314. It must also be understood that the slide surfaces 312 and 314 need not be directly opposite each other as shown in FIGS. 17–20. If the slide surfaces 312 and 314 are oriented so that the pawls 318 and 320 engage the teeth 30'' simultaneously, the ratcheting mechanism of wrench 300 will be strengthened if wrench 300 is to be used in unusually harsh applications. A simultaneous ratcheting action would occur if slide surface 314 were parallel line 317 seen in FIG. 20.

The operator can reverse the ratcheting operation of the ratchet wrench 300 by grasping the reverser plate 336 and moving the reverser pins 338 and 340 against the ends 348 of the curvilinear notches 328. This moves main spring 343 and the pawl pins 352 and 354 in the linear notches 330 to move the first and second pawls 318 and 320 into the second position. When the handle 20'' and head 22'' are rotated in the direction indicated by arrow 358, one of the pawls 318 and 320 will engage the teeth 30'' for joint rotation of the drive member through 302 and head 22''. When the head 22' is moved in the direction of arrow 356, ratcheting action occurs. Again, only one of the pawls 318 and 320 will be in engagement with the ratchet teeth 30'' at a given angular position. The decreased angular separation between ratchet engagements is therefore also present when the pawls are in the second position.

The cylindrical drive portion 304 of ratchet wrench 300 is adapted to secure any one of the sockets 14–18 thereon, as well as extension 12 and has the other features noted above with respect to the combined male and female drive portion 36 of socket wrench 10.

With reference now to FIGS. 21–24, several advantages of the hex sockets 14, 16 and 18 will become apparent. As seen in FIG. 21, the portion 108 of the socket 14 has an outer hexagonal surface 360 which forms a wrench engaging surface for rotating the socket 14 with a conventional open end wrench 362. This feature of the socket 14 is also present on sockets 16 and 18 and extension 12. The feature will permit the hex sockets to be used for loosening or tightening a member where an obstruction would prevent use of the hex socket with the ratchet wrenches disclosed herein, including wrenches 10 and 300.

FIG. 22 illustrates a comparision of a hex socket 14 and a conventional socket 364. In FIG. 22, the dimension a is the profile or height of the sockets. The dimension b is the diameter of the aperture in the hex socket 14 through which the shank of a bolt can protrude and is the size of the opening in the conventional socket 364 for receiving the square drive which is typically not large enough to allow the passage of larger bolts or shanks. The dimension c is the depth of the actual nut engaging portion of the socket. The dimension d is the built in depth.

As can be seen by comparing the socket 14 and conventional socket 364, the overall size of the hex socket 14 is decreased by the elimination of the portion forming dimension d. The weight of the hex socket 14 relative to the conventional socket 364 is reduced for an equivalent size because of the elimination of the portion forming dimension d and because of the large aperture forming dimension b and the hexagonal outer surface 108 of the socket 14. The dimension b on the hex socket 14 is larger than dimension b on the conventional socket 364 for equivalent size sockets, permitting the passage of a larger bolt shank, etc. when required.

With reference now to FIG. 23, the present invention permits the creation of a deep socket 370 by use of the hex socket 14 and a properly sized conventional socket 366 having a square drive portion 368. Naturally, the deep socket 370 shown in FIG. 23 would be operated by a conventional square drive socket wrench.

Reference is now made to FIG. 24 which illustrates the creation of a deep socket 372 using multiple hex sockets 14 of proper dimensions to form deep socket 372. It is clear that deep socket 372 may be operated by the ratchet wrenches disclosed herein including ratchet wrenches 10 and 300 and also by a closed or opened end wrench engaging the hexagonal outer surface 108 of the top socket 14. If desired, any of the hex sockets 14 can be provided with some structure for securing the sockets together during use.

With reference now to FIGS. 25–27, a square drive to hex drive adapter 380 is illustrated. The adapter 380 permits a conventional square drive socket wrench to be used to rotate hex sockets 14, 16 and 18 and the hex extension 12. The square drive to hex drive adapter 380 includes a square drive portion 382 having a cylindrical outer surface 384 and a square inner surface 386 for receiving the square drive of a conventional socket wrench. Adjacent the square drive portion 382 is a retention cylinder 388. The retention cylinder 388 has a circular aperture 390 formed therethrough as best seen in FIG. 26. Two parallel notches 392 are formed along the length of the retention cylinder 388 to define a retention tab 394. The retention tab 394 extends beyond the transition from the retention cylinder 388 to the male/female hex drive portion 396. The portion 396 has an outer hexagonal surface 100 and an inner hexagonal surface 102 for cooperation with the hex sockets 14, 16 and 18 and the extension 12. The retention tab 394 has a double bend 398 near its outer edge so that portions of the tab 394 extend both outward from surface 100 and inward from surface 102 to resiliently engage the hex sockets 14, 16 and 18 and the extension 12 when mounted on the male/female hex drive portion 396 of adapter 380.

With reference now to FIGS. 28 and 29, a hex drive to square drive adapter 400 is illustrated. The adapter 400 permits the use of a ratchet wrench having hex drive, including the ratchet wrench 10 described hereinabove to drive conventional square drive sockets such as sockets 364 and 366. The adapter 400 includes a hexagonal portion 402 having a hexagonal outer portion 404 which is adapted to engage the inner hexagonal surface 102 of drive portion 36 of the ratchet wrench 10. A groove 406 is provided in the hex portion 402 for engagement with any socket locking feature, such as the design described above on ratchet wrench 10 formed by member 130. The adapter 400 also includes a square drive portion 408 having a dimension to engage a conventional socket such as 364 and 366 so that a hex drive wrench can be used with conventional square drive sockets. The portion 408 can include a convention spring and detent ball 409 to lock a socket to portion 408.

Reference is now made to FIGS. 30–32 which illustrates a first modification of the breaker bar wrench 260 illustrated in FIG. 16. Only the head 268 is shown in FIGS. 30–32, but it will be understood that the head can be pivoted to a handle 262 by a pin 274. The head 268 illustrated in FIGS. 30–32 includes an aperture 410 formed through the outer hexagonal surface 278 and inner hexagonal surface 280. Aperture 410 is formed so that a hex socket such as sockets 14, 16 and 18 and extension 12 will cover the majority of aperture 410 when the hex socket is attached to the head 268. A reduced thickness portion 412 forms an extension of the aperture 410 which extends to the end of surfaces 278 and 280 over which the hex sockets are slid onto head 268. The aperture 410 and reduced portion 412 are adapted to receive a retainer spring 414 as best seen in FIG. 32. The retainer spring can be mounted in the head 268 by spreading the ends 416 and inset portions 418 over the reduced portion 412 and sliding the spring into the position shown in FIG. 32. The inset portions 418 will retain the spring 414 on the head 268 during normal operation. The outwardly extending portion 420 will contact hex sockets mounted on the outer surface 278 of the head 268 and the inwardly extending portion 421 will contact hex sockets mounted on the inner surface 280 of head 268 and will retain the sockets due to the frictional forces generated by the resiliency of the retainer spring 414. Retainer spring 414 has the advantages of being low cost, a single piece and easily replaceable, unlike conventional resilient type frictional socket locks.

It will be understood that retainer spring 414 can be used on any of the combined male/female drive portions described herein, including drive portion 36, drive portion 36', drive portion 182, head 268 and drive portion 306 to frictionally secure a hex socket on the drive portion provided that an aperture 410 and reduced thickness portion 412 are formed in the drive portion.

Retainer spring 414 can be substituted for member 130, member 130' or release 282.

While several embodiments of the invention have been illustrated in the accompanying drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A socket set for rotating fasteners, comprising:

a handle;

a drive member mounted on said handle, said drive member having an aperture of predetermined dimensions extending through the drive member, the aperture defining an inner drive surface of hexagonal cross section, said drive member further having an outer drive surface of hexagonal cross section;

at least one first socket having a drive member engaging section with an outer surface of hexagonal cross section for being received on the inner drive surface of the drive member and a fastener engaging section having a fastener engaging surface for engaging a first fastener to permit rotation of the first fastener by the drive member, the first socket having a through aperture aligned with the aperture in the drive member when engaged in the drive member, a portion of the aperture defining the fastener engaging surface, the drive member and first socket being suitable for use in close quarters, the aperture of predetermined dimensions in the drive member being sized to allow any object on which the first fastener is threaded to pass through the aperture to eliminate the need to use a deep socket to rotate the first fastener;

at least one second socket having a drive member engaging section having a fastener engaging surface and a fastener engaging section for engaging a second fastener, the second socket having an aperture formed therethrough, a portion of said aperture extending through said drive member engaging section, defining an inner surface of hexagonal cross section for being received on the outer drive surface of the drive member a portion of the aperture defining the fastener engaging surface of the second socket, the fastener engaging section for engaging a second fastener to permit rotation of the second fastener by the drive member, the fastener engaging surface of the second socket engaging larger fasteners than the fastener engaging surface of the first socket, the size of the aperture in the second socket being directly related to the size of the second fastener to accommodate an object on which the second fastener is threaded and the aperture through the drive member being unobstructed by the second socket, the aperture of predetermined dimensions in the drive member being sized to allow an object on which the second fastener is threaded to pass through the aperture to eliminate the need to use a deep socket to rotate the second fastener;

a plurality of third sockets, each of said third sockets having a drive member engaging section and a fastener engaging section having a fastener engaging surface, each of said third sockets having an aperture formed therethrough, the portion of the aperture in said drive member engaging section defining an inner surface of hexagonal cross section for being received on the outer drive surface of the drive member, the outer surface of said drive member engaging section having a hexagonal cross section, the outer surface of each of said third sockets having an identical cross section, the fastener engaging section for engaging a third fastener to permit rotation of the third fastener by the drive member, the the fastener engaging surface of the third sockets engaging larger fasteners than the second socket, the size of the fastener engaging surface of the aperture in the third sockets being directly related to the size of the third fasteners to accommodate an object on which the third fasteners are threaded, the mating of the inner surface of hexagonal cross section on the drive member engaging section of the third sockets and the outer drive surface of the drive member permitting the aperture in the drive member to remain unobstructed; and the third sockets being capable of being nested together to form a deep socket to rotate a third fastener, with the drive member engaging section of a selected one of said third sockets engaging the drive member, the fastener engaging section of said selected third socket being sized to accept the identical cross section outer surface of the drive member engaging section of each of the other third sockets for joint rotation, the combined aperture through the engaged third sockets being aligned to form a deep set socket to eliminate the need for separate single piece deep set sockets, the combined aperture of the nested third sockets being larger than the aperture of predetermined dimensions in the drive member to permit the drive member to be used to rotate third fasteners threaded to an object which will not pass through the aperture of the predetermined dimensions in the drive member.

2. The socket set of claim 1 further comprising an adapter for use in adapting the drive member to a conventional socket having an aperture of square cross section for receiving a square drive for joint rotation, comprising:

a hexagonal section having an outer surface of hexagonal cross section for being received on said inner drive surface of said drive member; and a square drive portion having a square cross section for entering the aperture in the conventional socket for permitting the conventional socket to be rotated by said drive member.

3. The socket set of claim 1 further comprising an adaptor for use with a drive member having a drive portion of square cross section and said first, second and third sockets, comprising:

a driven portion having an aperture therein of square cross section adapted to receive the drive portion of the drive member; and a combined male/female hex drive portion having an aperture of hexagonal cross section for engaging the first socket having an outer portion of hexagonal cross section and an outer surface of hexagonal cross section for engaging the second and third sockets having an inner portion of hexagonal cross section.

4. The socket set of claim 1 wherein said the outer surface of hexagonal cross section in the drive member attaching section of the first socket is adapted for engagement with conventional box and open end wrenches.

5. The socket set of claim 1 wherein said handle and drive member form a power wrench.

6. The socket set of claim 1 wherein said handle is a screwdriver handle.

7. A wrench assembly for receiving a socket to rotate a fastener, comprising:

a handle having a head at one end thereof;

a drive member for mounting on the head, said drive member having a drive portion with inner and outer surfaces extending along a first direction, the outer surface of the drive portion having a hexagonal cross section perpendicular to the first direction and adapted for receiving a socket, the inner surface of the drive portion having a hexagonal cross section perpendicular to the first direction and adapted for receiving a socket, said drive member further having an aperture formed through the inner and outer surfaces and a reduced thickness portion extending from one end of the aperture; and resilient spring means surrounding the reduced thickness portion of the drive member to retain the resilient spring means on the drive member even without a socket received on the drive member and having first and second resilient arms extending from said resilient spring means within the aperture, said first resilient arm having a socket contacting portion extending out of the aperture for engagement with a socket received on the outer surface of the drive member to frictionally secure the socket to the drive member by resiliently deflecting the first resilient arm relative to the drive member, said second resilient arm in the aperture having a socket contacting portion extending out of the aperture for engaging a socket received by the inner surface of the drive member to frictionally secure the socket to the drive member by resiliently deflecting the second resilient arm relative to the drive member.

8. A resilient member for use in securing a socket to a combined male/female drive portion, the drive portion having an outer surface of non-circular cross section and an aperture defining an inner surface of non-circular cross section, the drive portion further having an aperture formed through the surfaces and a reduced thickness portion extending from one end of the aperture, said resilient member comprising:

(a) a first portion surrounding the reduced thickness portion of the drive portion and to retain the resilient member on the drive portion even without a socket received on the drive portion;

(b) an outwardly extending arm extending from the first portion within the aperture and having a socket engaging surface extending through the outer surface for frictionally engaging a socket by resiliently deflecting the outwardly extending portion relative to the drive portion; and (c) an inwardly extending arm extending from the first portion within the aperture and having a socket engaging surface extending through the inner surface for frictionally engaging a socket by resiliently deflecting the inwardly extending portion relative to the drive portion.

* * * * *